United States Patent [19]

Irwin

[11] Patent Number: 4,854,133

[45] Date of Patent: Aug. 8, 1989

[54] COIN SUPPORTS

[76] Inventor: Eric Irwin, Fairlawns, Station Lane, Mickle Trafford, Chester, England

[21] Appl. No.: 860,918

[22] Filed: May 8, 1986

[30] Foreign Application Priority Data

May 8, 1985 [GB] United Kingdom ..... 8511581

[51] Int. Cl.[4] ..... A44C 9/00

[52] U.S. Cl. ..... 63/15; 63/154

[58] Field of Search ..... 63/18, 29 R, 15, 15.3, 63/15.7; 40/23, 323; 406/8, 9, 10, 11, 12, 13; 206/0.81, 0.8, 0.82, 0.83

[56] References Cited

U.S. PATENT DOCUMENTS

| | | | |
|---|---|---|---|
| D. 123,675 | 11/1940 | Jacobi | D99/34 |
| D. 203,737 | 2/1966 | Friedman | D99/34 |
| 193,758 | 7/1877 | Faas | 63/18 |
| 851,078 | 4/1907 | Dunn | 206/0.82 |
| 944,744 | 12/1909 | Pine | 40/323 |
| 1,362,384 | 12/1920 | Burger | 63/18 |
| 2,239,009 | 4/1941 | Mark | 63/18 |
| 2,511,651 | 6/1950 | Schlitz | 40/323 |
| 2,716,483 | 8/1955 | Nauman | 206/0.81 |
| 3,105,592 | 10/1963 | Cohen | 206/0.8 |
| 3,125,214 | 3/1964 | Merila | 206/0.8 |
| 3,568,467 | 3/1971 | Ellison | 63/29 R |
| 3,618,338 | 11/1971 | Sauer | 63/19 |
| 3,657,909 | 4/1972 | Boswell | 206/0.81 |
| 3,996,766 | 12/1976 | Welch | 63/18 |
| 4,197,665 | 4/1980 | Siiter | 63/18 |

FOREIGN PATENT DOCUMENTS

| | | | |
|---|---|---|---|
| 0063751 | 11/1982 | European Pat. Off. . | |
| 379173 | 9/1907 | France | 40/23 |
| 1077460 | 7/1967 | United Kingdom | 63/18 |
| 1200257 | 7/1970 | United Kingdom . | |
| 1260808 | 1/1972 | United Kingdom | 63/18 |
| 1338920 | 11/1973 | United Kingdom | 63/18 |

*Primary Examiner*—Robert A. Hafer
*Assistant Examiner*—Michael Brown
*Attorney, Agent, or Firm*—Fleit, Jacobson, Cohn, Price, Holman & Stern

[57] ABSTRACT

The present invention provides a coin support including a pair of coaxially aligned rings which are axially spaced apart from each other. The rings are secured together over a limited part of their circumference with releasable retaining means being arranged to interconnect the remainder of the respective circumferences at at least one location. Thus a selected coin can be easily slid between the rings and can be simply secured therein by closing or attaching the retaining means. The rings can be incorporated in a decorative ring for a person's finger or supported on a chain to be worn around a person's neck.

7 Claims, 2 Drawing Sheets

COIN SUPPORTS

DESCRIPTION

The present invention relates to a support for use in securely holding a coin.

In particular the present invention relates to a support for a coin, which enables the coin to be suspended on, for example, a chain around a person's neck.

One known coin support is in the form of a metal ring which has a channel or groove formed on its inside surface. The ring is broken at one point of its circumference so that the ring can be flexed to increase its diameter and allow a coin to be inserted in the said channel. The ring is then flexed back to its circular configuration wherein the ends of the ring forming the break interengage, and eyelets formed on each of said ends are aligned so that a small broken ring can be engaged through the aligned eyelets. The small broken ring thus holds the coin support ring in a circular configuration retaining the coin in position, and a chain may be attached to the small broken ring.

With the above known coin support, the coin can move within the support and packing is often required. Further, it is a difficult operation to insert a coin, align the eyelets and insert the small broken ring. Thus, when a coin has been selected by a purchaser, the support and coin often has to be passed to a manufacturing jeweller to complete the assembly. This is both costly and causes a delay before the purchaser can take away the item.

Another known coin support is cast out of a suitable metal, and is again in the form of a ring. This ring is however, closed, and has a groove formed in the rear face. Thus, a coin can simply be engaged in the groove from the rear of the ring, and claws integral with said ring can be deformed over the edge of the coin to secure the coin in position. Whilst the coin is securely held in the support, the item has an aesthetically appealing front, but the claws detract from the appeal of the rear of the item.

The aim of the present invention is to provide an aesthetically appealing coin support which is simple in construction and in which a coin can be very simply inserted and retained.

According to the present invention there is provided a coin support comprising a pair of coaxially aligned rings which are axially spaced apart from each other, said rings being secured together over a limited part of their circumference, with retaining means being arranged to interconnect the remainder of the respective circumferences at at least one location.

In one embodiment of the present invention, the support is cast out of a suitable metal and can have any desired decorative surface configuration. However, basically the support comprises two coaxially aligned rings which are axially spaced apart, the rings being joined together for approximately half their respective circumferences. On the remainder of the respective circumferences, two aligned eyelets are provided. Thus a coin of appropriate diameter can be simply inserted in the open region between the rings and when fully inserted, a small broken ring can be inserted through the aligned eyelets to engage the edge of the coin and hold the coin in position. A chain can then be secured to the small broken ring.

Whilst the rings of this embodiment are joined together by a continuous wall, a series of spaced-apart struts may equally well suffice.

Further, whilst this embodiment is cast, if a lighter support is required, the support may be stamped out of a suitable metal. In this case, the two rings are stamped out, interconnected at one point. The rings can then be folded together about the interconnection, and either soldered together or secured together by struts.

In another embodiment of the present invention the support takes the basic form of a decorative ring to be worn on a person's finger, said pair of coaxially aligned rings being arranged with their common axis at 90° to the axis of the body of the decorative ring. Whilst the ring of said pair of aligned rings, remote from the axis of the decorative rings, is complete, the ring nearest the axis of the decorative ring is broken into two virtually semi-circular segments, one semi-circular segment being secured to the complete ring and the other semi-circular segment being fixed in a recess in the body of the decorative ring. Said complete ring and said attached segment, are pivotally mounted in said recess so that said complete ring and said attached segment, can be pivoted from a completed position wherein said complete ring and said attached segment are located completely within the recess and are parallel with said other segment, thereby defining said pair of coaxially aligned rings, and an open position wherein said complete ring projects out of said recess. In said open position, said complete ring and the attached segment, form a pocket into which a suitably sized coin can be inserted. Then the complete ring and attached segment, together with the inserted coin, can be pivoted to the completed position, said complete ring being an interference fit in said recess to maintain the complete ring and attached segment in said completed position. Alternatively, detent means, e.g. a projection and complimentary recess, can be provided to maintain the complete ring and attached segment in the completed position, the projection being on the complete ring and the complementary recess being in the body recess, or vice versa.

The present invention thus provides a simple coin support which can be quickly and easily used with an appropriate diameter coin, immediately a purchaser had made his/her selection.

The present invention will now be further described, by way of example, with reference to the accompanying drawings, in which.

Figure 1:
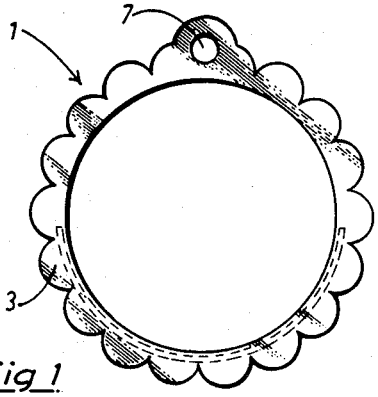
FIG. 1 is a front elevation of one embodiment of the present invention.
Figure 2:
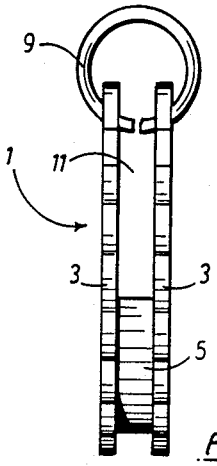
FIG. 2 is a side elevational of FIG. 1 with a small broken ring attached.

The coin support 1 shown in FIGS. 1 and 2 of the accompanying drawings is cast out of a suitable metal and comprises two coaxially aligned rings 3 which are axially spaced apart from each other. The rings 3 are joined together by continuous wall 5, for approximately half the circumference of the rings 3, though alternatively, spaced apart transverse struts (not shown) can be substituted for the wall 5. Two aligned eyelets 7 are formed on the remainder of the respective ring circumferences and as illustrated in FIG. 2, a small broken ring 9 can be inserted through both of these eyelets 7.

Thus, with the small broken ring 9 removed, a coin can be inserted in the open region 11 between the rings 3. With the coin fully inserted, the small broken ring 9 can be inserted in both eyelets 7 to engage the edge of the coin and securely hold the coin in the support 1. A chain (not shown) can then be secured to the small broken ring 9 to enable the coin to be worn around a person's neck.

Figure 3:
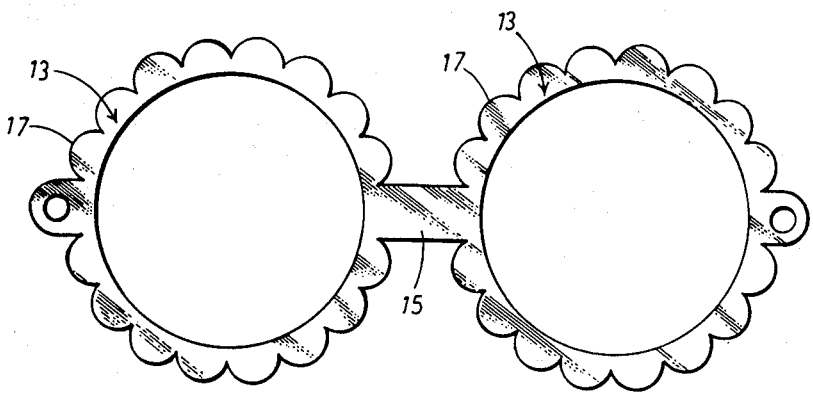
FIG. 3 is a front elevation of a stamped blank for constructing a further embodiment of the present invention.
Figure 4:
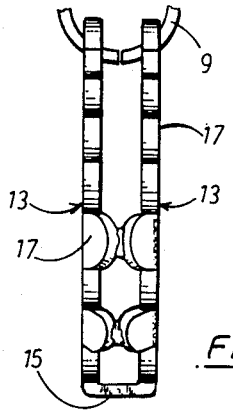
FIG. 4 shows the completed further embodiment.

If a lighter coin support is required then it must be stamped out of a suitable metal as shown by way of example, in FIG. 3 of the accompanying drawings. This stamping comprises two ring regions 13 interconnected at 15. The ring regions 13 each have a serrated outer periphery 17 and alternate serrations over part of the ring circumference are, after stamping, bent over at right angles to the general plane of the ring regions 13. Then the ring regions 13 are folded together about the interconnection 15 so that the tips of the bent serrations engage and can be soldered together to form the completed coin support shown in FIG. 4.

Alternative stamping designs are, of course, possible within the present invention.

Figure 6:
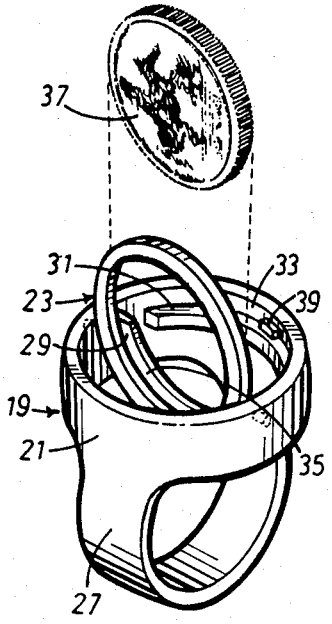
FIG. 6 is a perspective view of the ring of FIG. 5 in an open position.
Figure 7:
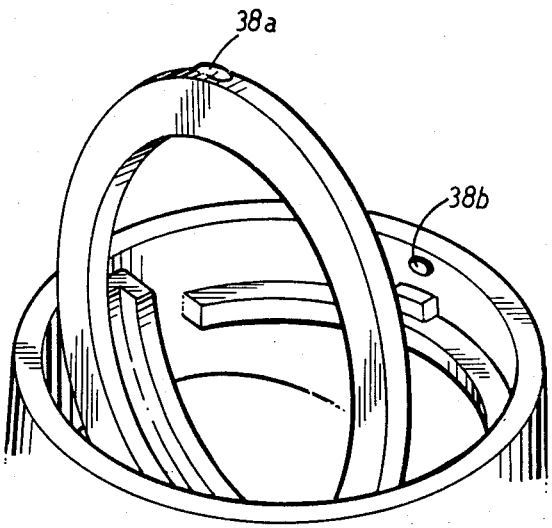
FIG. 7 is an enlarged partial detail of the embodiment of FIGS. 5 and 6.
Figure 5:
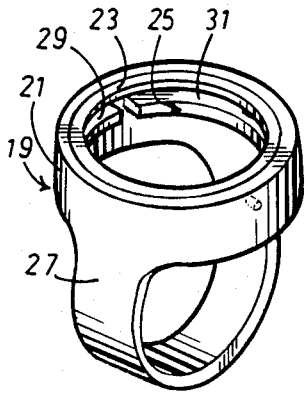
FIG. 5 is a perspective view of a still further embodiment of the present invention constructed as a decorative ring to be worn on a person's finger.

The coin support shown in FIGS. 5, 6 and 7 of the accompanying drawings takes the basic form of a decorative ring 19 to be worn on a person's finger. The ring 19 has a body 21 incorporating a pair of coaxially aligned rings 23,25 and a circular band 27 which, in use, engages around a person's finger. The pair of coaxially aligned rings 23,25 are arranged with their common axis at 90° to the axis of the circular band 27. The ring 23 remote from the axis of the circular band 27 is complete whilst the other ring 25 is broken into two virtually semicircular segments 29,31. One segment 29 is secured to the complete ring 23, and the other segment 31 is fixed in a recess 33 in the body 21. The complete ring 23 and attached segmemt 29 are pivotally mounted in said recess 33 so that the complete ring 23 and said attached segment 29 can be pivoted from a completed position (see FIG. 5) wherein said complete ring 23 and said attached segment 29, are located completely within the recess 33 and are parallel with said other segment 31, thereby defining two coaxially aligned rings, to an open position (see FIG. 6) wherein said complete ring 23 projects out of said recess 33. In said open position, said complete ring 23 and the attached segment 29, from a pocket 35 into which a suitably sized coin 37 can be inserted. Then the complete ring 23 and attached segment 29 together with the inserted coin 37 can be pivoted to the completed position (FIG. 6), said complete ring 23 being an interference fit in said recess 33 to maintain the complete ring 23 and attached segment 29 in said completed position.

Alternatively, detent means (see FIG. 7), e.g. a projection 38*a* and complimentary recess 38*b*, can be provided to maintain the complete ring 23 and attached segment 29 in the completed position, the projection 38*a* being on the complete ring 23 and the complimentary recess 38*b* being in the body 21 of the decorative ring (as illustrated), or vice versa. Further, to accurately locate said complete ring 23 in the required complete position in the recess 33, relative to said other segment 31, a spacer 39 is provided on the body 21 within the recess 33, contiguous to the said other segment 31, said complete ring 23 engaging against the spacer 39 on the required completed position.

The present invention thus provides a simple coin support which can be quickly and easily used by the non-expert to mount a coin virtually immediately a purchaser has made his/her selection.

I claim:

1. A coin support comprising:

a pair of coaxially aligned rings axially spaced apart from each other to define a channel for receipt of a coin between said rings, said rings being permanently secured together over a limited part of their circumference to permanently fix said rings together so as to prevent movement of one of said rings with respect to the other, and retaining means being arranged to interconnect said rings at at least one location and thereby block removal of a coin from said channel located between said rings.

2. A coin support according to claim 1, wherein said retaining means includes two aligned eyelets located one on each of said rings, with a broken ring detachably engaged through both of said eyelets.

3. A coin support according to claim 2, wherein said rings are joined together continuously for half their respective circumferences.

4. A coin support according to claim 2, wherein said rings are joined together by circumferentially spaced apart connections secured to both rings.

5. A coin support comprising:

a body of a decorative ring for a person's finger, two coaxially aligned annular and circular rings mounted in said body and spaced from each other, one of said two rings being a complete ring and the other of said two rings including two curved segments, one of said two curved segments being secured to said one ring in a spaced relation from said one ring to define a pocket for receipt of a coin between said one ring and said one segment and the other of said two curved segments being secured to an interior curved surface of said body, said one ring being pivotally mounted on said body at diametrically opposed locations so as to be pivoted between a completed position where said one segment is coplanar with said other segment and said one ring lies over said two curved segments and defines a protective surface about an entire peripheral edge of a coin inserted in said pocket and an open position where said one ring projects partially from and above said body for receipt of a coin in said pocket.

6. A coin support according to claim 5, wherein said one complete ring is in an interference fit with said body in said completed position.

7. A coin support according to claim 5, wherein interengaging detent means formed on said one ring and said body form retaining means.

* * * * *